United States Patent [19]

Bünger et al.

[11] Patent Number: 4,907,635

[45] Date of Patent: Mar. 13, 1990

[54] LIFTABLE WINDOW DRAPE

[75] Inventors: Hans-Joachim Bünger, Wuppertal; Bernhard Kuttenkeuler, Freudenberg, both of Fed. Rep. of Germany

[73] Assignee: August Bünger Bob-Textilwerk KG GmbH & Co., Wuppertal, Fed. Rep. of Germany

[21] Appl. No.: 252,366

[22] PCT Filed: Dec. 23, 1987

[86] PCT No.: PCT/EP87/00823

§ 371 Date: Aug. 31, 1988

§ 102(e) Date: Aug. 31, 1988

[87] PCT Pub. No.: WO88/04906

PCT Pub. Date: Jul. 14, 1988

[30] Foreign Application Priority Data

Dec. 31, 1986 [DE] Fed. Rep. of Germany ... 8634909[U]
Dec. 4, 1987 [DE] Fed. Rep. of Germany ... 8716047[U]

[51] Int. Cl.[4] ..... A47H 23/00
[52] U.S. Cl. ..... 160/84.1; 160/348
[58] Field of Search ..... 160/84.1, 348, 330

[56] References Cited

U.S. PATENT DOCUMENTS 4,501,311 2/1985 Folland .

FOREIGN PATENT DOCUMENTS 204643 12/1986 European Pat. Off. .
3009992 10/1980 Fed. Rep. of Germany .
8200021 5/1982 Fed. Rep. of Germany .
8415177 3/1984 Fed. Rep. of Germany .

*Primary Examiner*—Blair M. Johnson
*Attorney, Agent, or Firm*—Peter K. Kontler

[57] ABSTRACT

In a liftable window drape (10), such as a window shade with straight pleats or a curtain with rounded pleats, a fabric web (11) is employed which, on its rear side, has several parallel, vertical rows (16,17) of loops with guide elements. The latter can be produced by a folding band affixed to the rear side of the fabric web (11). The drawstring (21) is secured at the lower marginal region of the fabric web (11) and extends to a carrier (29) secured in the upper marginal region of the fabric web (11). In order to assure a satisfactory appearance of the window drape (10) and to easily adjust this to changing window heights, it is proposed to let the loops in the rows extend horizontally and to form each loop from a bundle of weft threads (24) which float over the fabric web (11) or over the folding band. A connector is threaded through at least two vertically spaced weft bundles (24) and guides these towards one another while the region of the fabric web therebetween is gathered to form a permanent horizontal pleat (44).

21 Claims, 6 Drawing Sheets

Figure 1:
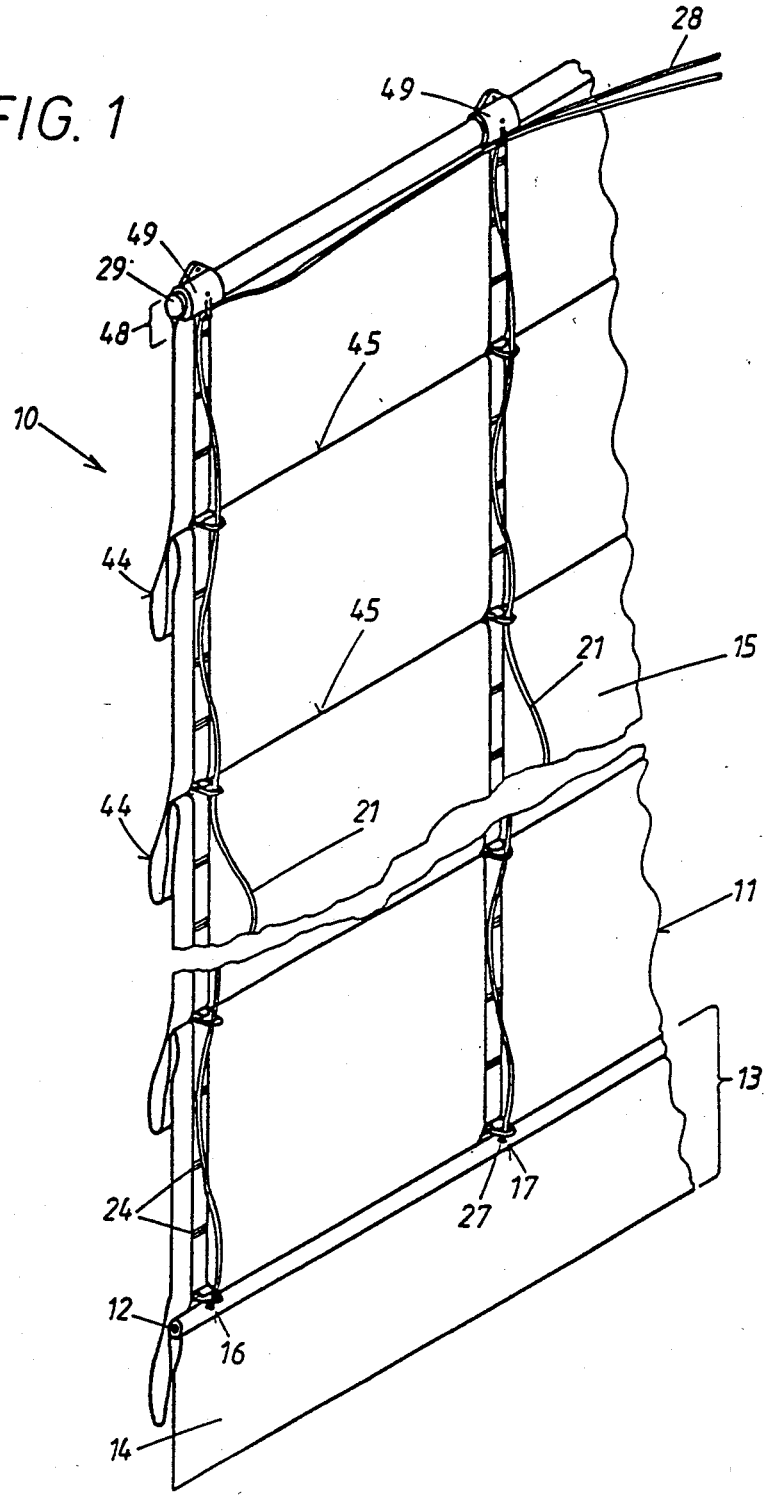

FIG. 15
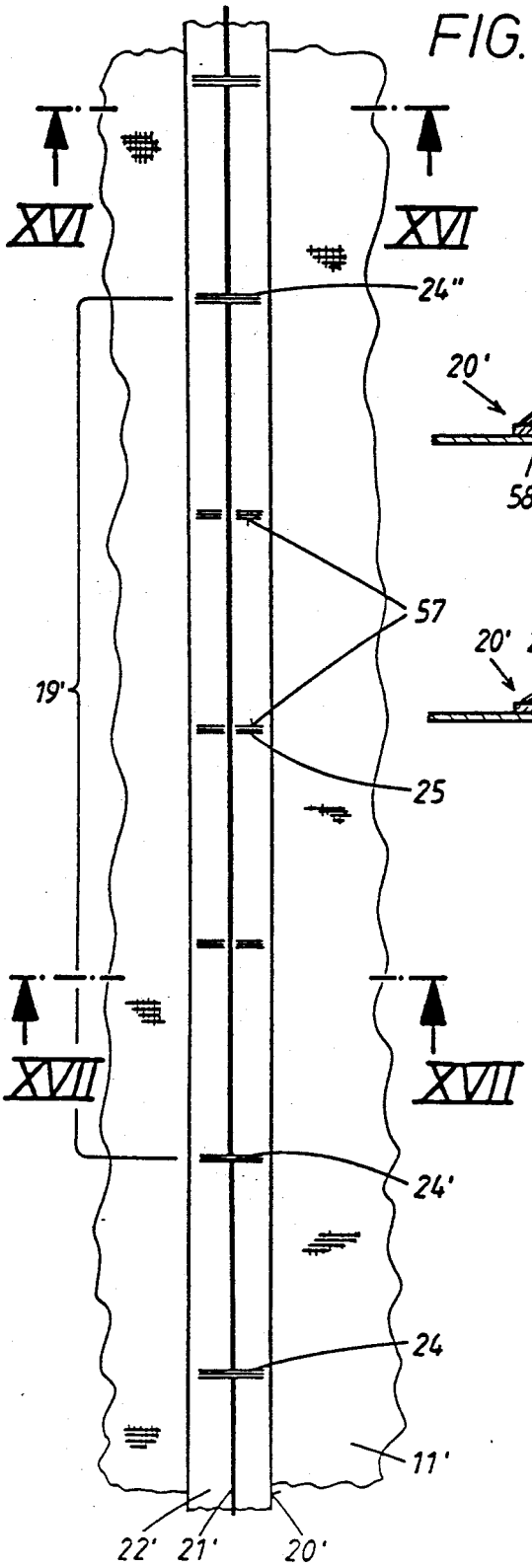
FIG. 16
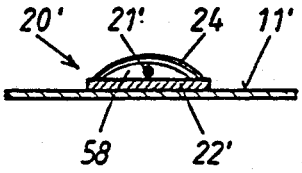
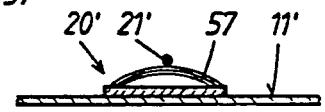
FIG. 17
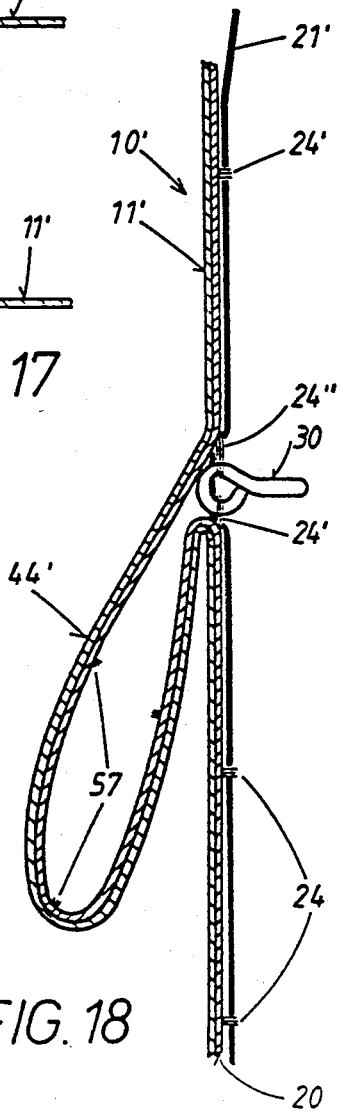
FIG. 18

LIFTABLE WINDOW DRAPE

The invention relates to a liftable window drape. The primary purpose of such a drape is to function as a barrier to sight. At the same time, it is required to perform a decorative function; it serves as a window decoration and is accordingly from fabric webs of curtain material, especially in the form of woven and knit goods. This window drape typically has bands with loops for guide elements fastened to one of its sides, hereinafter denoted the rear side. The drawstrings allow the window drape to be raised to a desired degree during which the fabric web comes together uncontrollably between the guide elements thereby affecting the good appearance of the window drape. Furthermore, it is necessary to cut the window drape to the particular height of the window which is troublesome. In the known drape (European Patent Application No. 0 118 700), the loops extend vertically in the longitudinal direction of the band and an individual loop serves to hang a plate-shaped guide element.

It is an object of the invention to develop an inexpensive window drape which can be used equally well for different window heights and distinguishes itself by an attractive, satisfactory appearance both in the extended and gathered condition of its fabric web. According to the invention, this is achieved by the measures which have the following special significance:

Since the loops on the rear side of the fabric web consist of simple, floating weft bundles, economical production is assured. These weft bundles can either be directly fastened to the fabric web or can belong to a prefabricated folding band which is only later secured to the rear side of the fabric web, e.g., by sewing. The weft bundles, however, do not function, as described more fully below, only for direct or indirect guidance of the drawstrings. Rather, they also constitute gripping means for a connector which is threaded through at least two vertically spaced weft bundles belonging to a common drawstring. As a result, the region of the fabric web located therebetween is, at this location, gathered into a horizontal pleat which also remains in the extended condition of the window drape, that is, when the drawstring is completely released, and thus establishes the appearance of the curtain in the basic condition. Depending upon which weft bundles are engaged and drawn together by a connector and, further, the manner in which the associated neighboring weft bundles are joined by analogous connectors, a different appearance is achieved for the fabric web which is gathered in various ways. Beginning with a window drape of one sort, this dual function of the weft bundles makes it possible to create a large selection of different decorations. The horizontal pleats which thereby arise also establish a pre-bending location in the fabric web which, when the fabric web is raised via the drawstrings, bends further at this preferred location and accordingly also provides for a good appearance of the window drape in the gathered condition.

The invention can fundamentally be carried out in two ways each of which has its special advantages. One possibility is to also give the connector a dual function, namely, not only to be the generator of horizontal pleats but, at the same time, to serve as a guide element for the associated drawstring. To this end, it is sufficient to provide the connector with a guide eye through which the drawstring of the finished window drape is then passed. In this manner, the window drape is to be moved with all of the connectors so that all locations which serve to guide the various drawstrings simultaneously fulfill the function of permanently gathering horizontal pleats in their region.

An alternative of the invention makes it unnecessary to manufacture additional guide elements for the drawstring and to mount these on the weft bundles since, in this embodiment of the invention, the weft bundles themselves take over this function. This invention can be considerbly simplified if the drawstring is worked in like an "intermediate layer" during the textile production of the weft bundles themselves. Thus, in this case, complicated threading of the drawstring is unnecessary since this is already brought in previously during production of the weft bundles by weaving or knitting.

In the last case, the invention with its gathering of horizontal pleats has the great advantage that the drawstring extends linearly in the gathering region of the fabric web so that an excess length increment is obtained which can be used for the guidance of the drawstring in the upper region of the window drape. Thus, upon working the drawstring into the fabric web or the associated folding band, the drawstring has the same starting length as the not yet gathered, flat fabric web. It is of particular advantage here to secure the upper drawstring end to a take-up spool which, upon rotation, then makes it possible to raise the fabric web. In this case, only small excess increments of length, which are generated by the local gathering according to the invention, are required.

For satisfactory gathering, it is meaningful not to let the drawstring extend below but, rather, above the weft bundles in this region. If here the drawstring is, as mentioned, worked in as an intermediate layer during the textile production of the carrier band or the curtain, then the utmost care will be taken at the outset to insure that the drawstring does not engage the weft bundles from below in these gathering regions. An alternative, however, is to cut through the weft bundles which, in an undesired manner, are engaged from below while strengthening of the cut regions is possible. To the extent that various patterns are required and cutting of the weft bundles is to be avoided, an alternative provides that different drawstrings be passed through the various weft bundles in different patterns. Thus, by selecting the appropriate drawstring, one of several different ways of gathering the fabric web may be realized when the connectors are correspondingly placed.

There are different possibilities, each of which brings with it special advantages, for the production of the connectors. Basically, it is sufficient to start from a ring-shaped body in accordance with claim 10. To simplify the threading, it is possible, however, to make it flexible and only subsequently fix it in the ring shape. Locking halves at the ends of a flexible strip are suitable for this purpose.

Another embodiment of the connector is formed from a hook which is here threaded through the various weft bundles. To simplify manipulation, a shape should be employed where the eye can simultaneously assume the initially outlined function of defining the guide eye for the later drawstring. Accordingly, the connector is at the same time the drawstring guide element at this location of the fabric web. Easy manipulation together with secure incorporation of the engaged weft bundles are achieved by certain additional measures. The diametrically opposite arrangement of the bearing locations assures a defined positioning of the associated connector or guide element. By suitably orienting the yoke, there is achieved the great advantage that the yoke then projects rearwards vertically from the fabric web gathered at this location and thereby allows passage of the associated drawstring particularly well and free of friction. This manifests itself in easy manipulation of the drawstring upon raising the fabric web. A transverse web assures that a drawstring passed through the yoke eye does not collide with the hook and cannot become caught thereon.

Several embodiments of the invention are illustrated in the drawings with the invention being drawn to all new features even if these are not expressly set forth in the claims.

Figure 2:
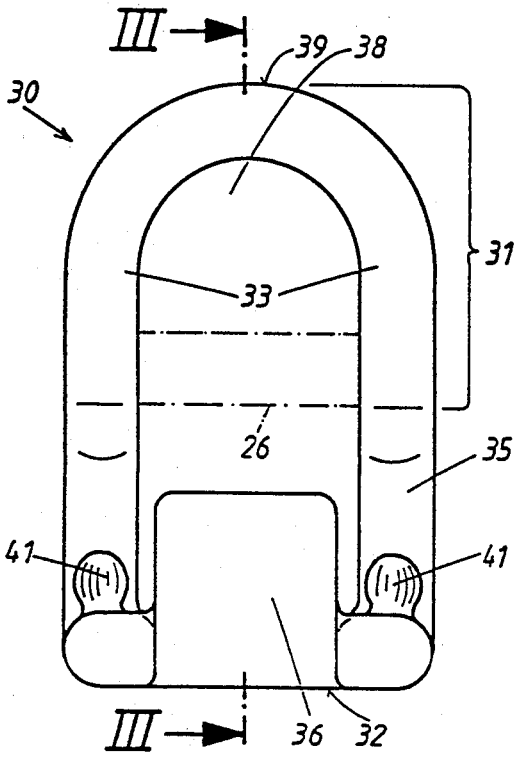
Figure 3:
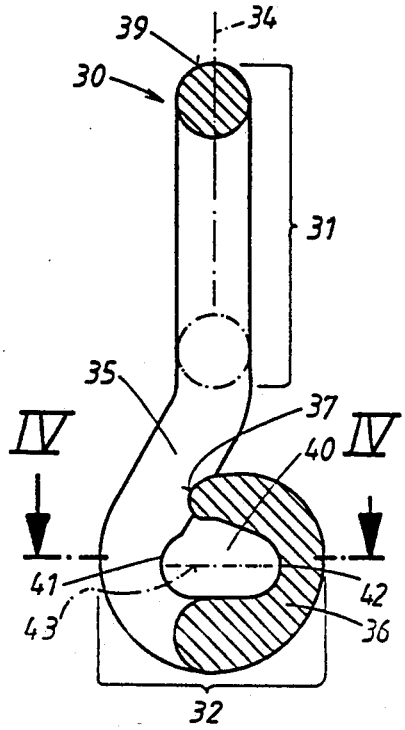
Figure 5:
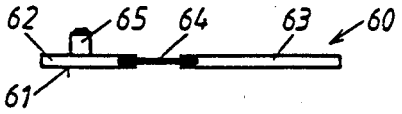
Figure 4:
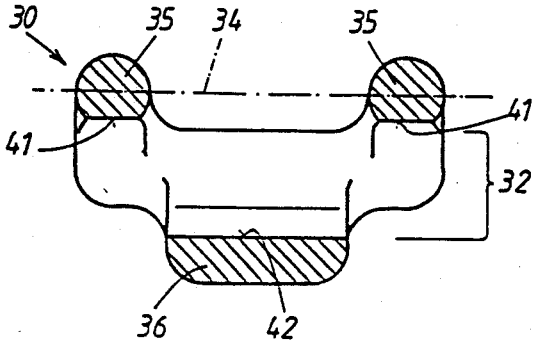
Figure 6:
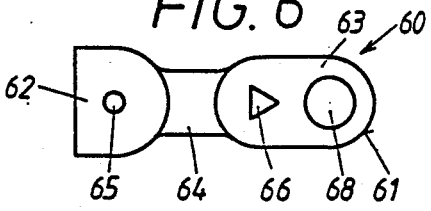
Figure 7:
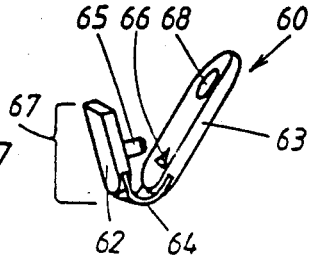
Figure 8A:
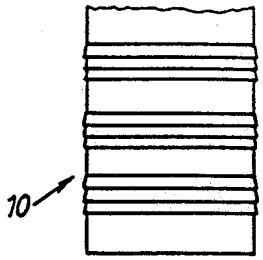
Figure 11A:
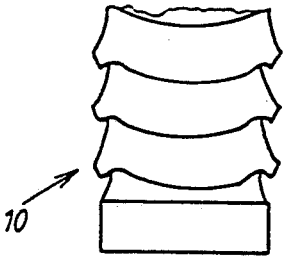
Figure 12A:
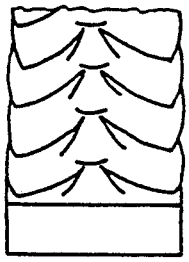
Figure 11B:
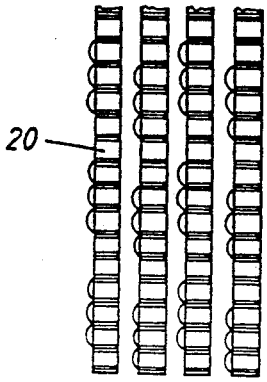
Figure 12B:
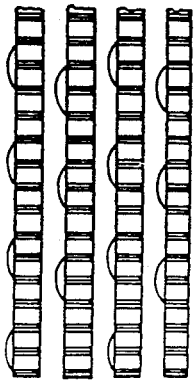
Figure 13:
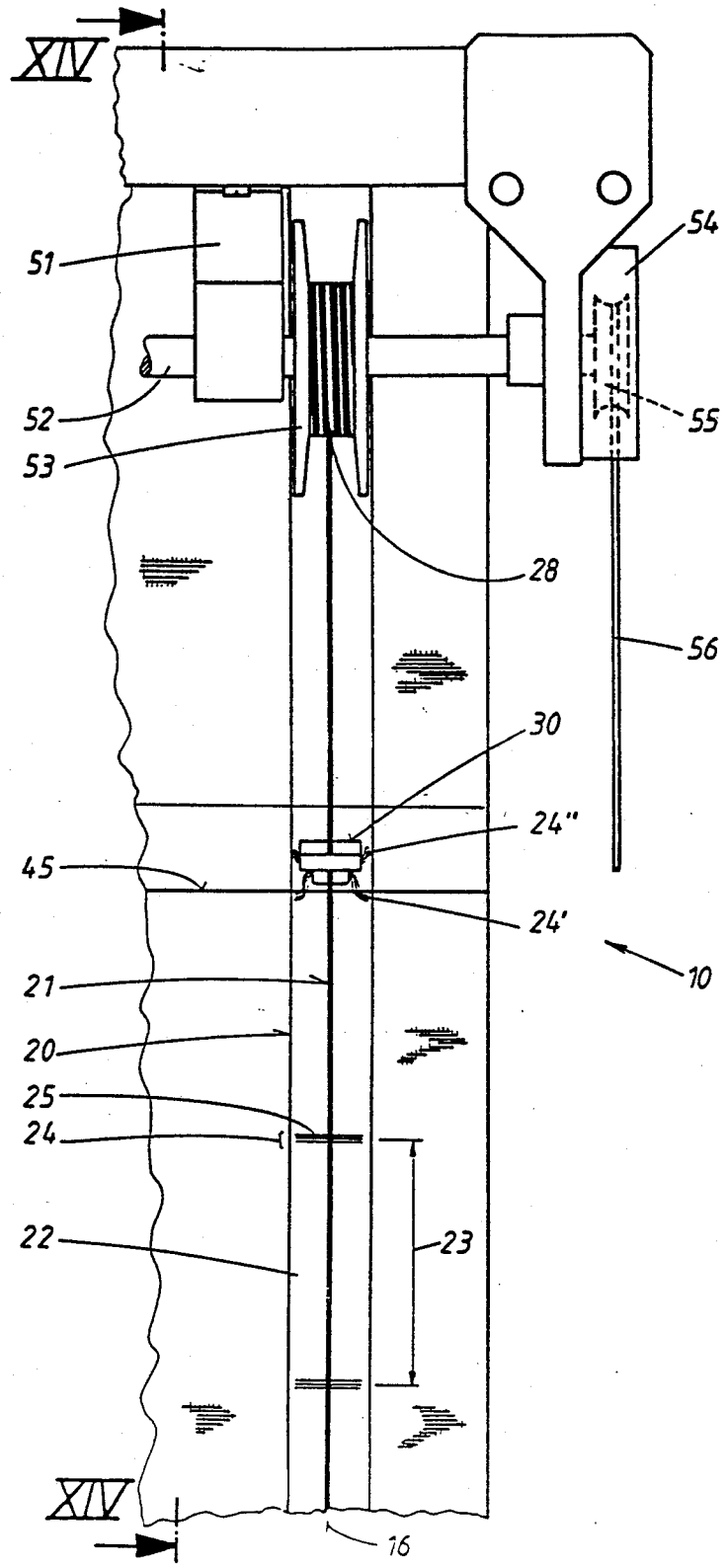

There are shown in:

FIG. 1 a perspective view of the rear side of a first embodiment of a window drape according to the invention, FIGS. 2–4 the plan view, the longitudinal section and the transverse section through a first embodiment of a connector which can be used for the invention, FIGS. 5, 6 and 7 a side view, a plan view and a perspective illustration of a second embodiment of the connector in accordance with the invention prior to use, FIGS. 8A to 12A schematically the visible side of window drapes according to the invention which are gathered differently per the invention, FIGS. 8B to 12B the associated folding bands on the other side of the fabric web and, by means of drawn in arcs, the corresponding gathering of the various weft bundles in order to obtain the respective pleat design according to FIGS. 8A to 12A, FIGS. 13 and 14 the rear view and the sectional view along the section line XIV—XIV in FIG. 13 of a first embodiment of the window drape in accordance with the invention, FIG. 15 the fabric web of a further fabric drape according to the invention in the extended condition and prior to hanging, FIGS. 16 and 17 the sectional views through the fabric web of FIG. 15 equipped with a folding band along the section lines XVI—XVI and XVII—XVII of the latter Figure, and FIG. 18 a longitudinal sectional view through a portion of the window drape produced with the fabric web of FIG. 15.

The window drape 10 illustrated in FIG. 1 includes a flexible fabric web 11 which is weighted in its lower marginal portion or region 13 by a rod 12 advantageously inserted in a fabric web tube. A frill 14 constituting a decorative termination may still be provided thereafter. On the rear side 15 of the fabric web 11 visible in FIG. 1, there are arranged several rows 16 of identical carrier bands 20 which directly serve to guide a drawstring or line 21 and have an appearance and function best seen from FIGS. 13 and 14. The bands 20 may be in the form of mesh goods or a woven web.

Figure 14:
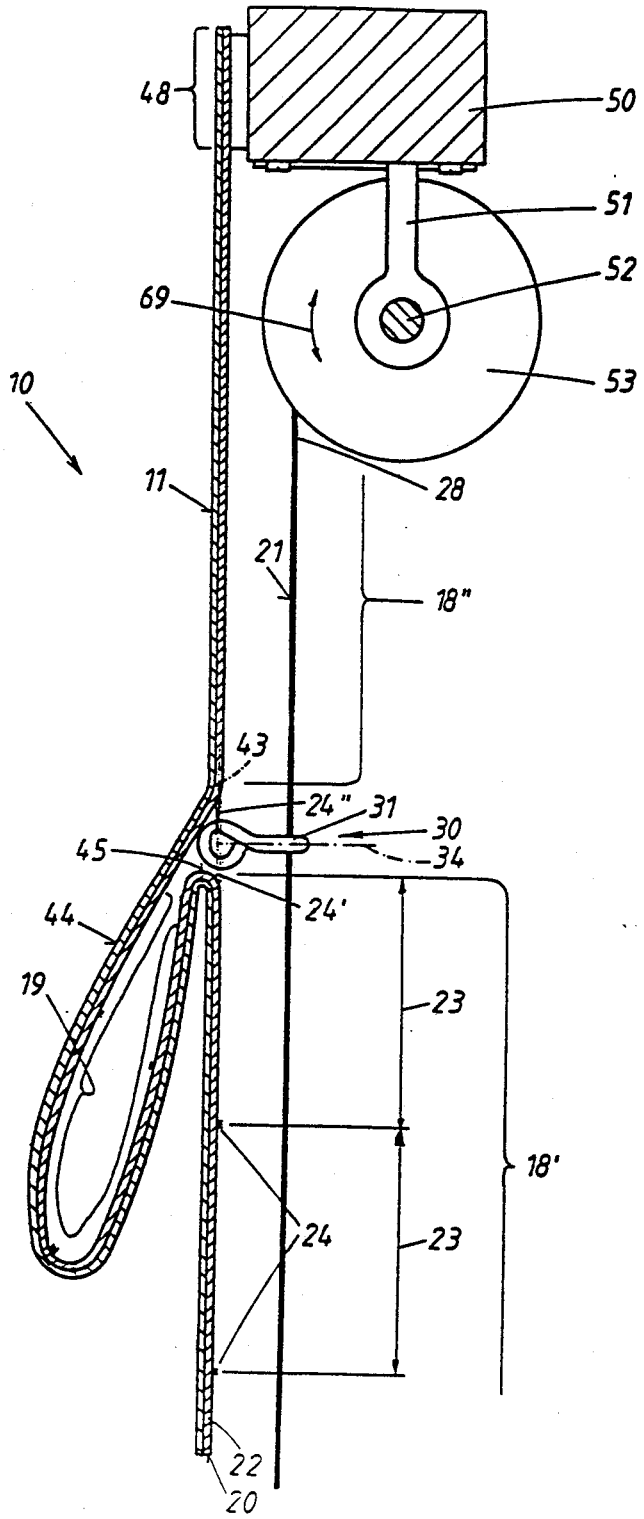

The band 20 is affixed to the fabric web 11 by sewing. Alternatively, it would also be possible to apply the band 20 to the fabric web 11 by fusion which may be quickly and easily accomplished by ironing with a flatiron or the like. The band 20 includes a solid band base 22 with projecting bundles 24, which are provided at predetermined spacings 23, of threads 25 floating transversely to the longitudinal direction of the band. These constitute weft threads during web production of the band 20 and the bundles will, accordingly, hereafter be referred to in short as "weft bundles 24". The weft threads 25 extend to the vicinity of the two longitudinal margins of the band base 22. A firmly woven band base is disposed beneath the weft threads 25. In the hung condition of FIG. 1, the weft bundles 24 extend horizontally. As best seen in FIGS. 13 and 14, a holding element or connector 30 is threaded through weft bundle pairs 24',24" disposed at selected locations.

The connector 30 used here is shown greatly enlarged in FIGS. 2 to 4. The connector 30 is made of one piece from synthetic resin and includes a U-shaped yoke or handle 31 formed with a specially shaped hook or ring-shaped holding section 32. The two yoke legs 33 initially extend, together with the U-arc, in a common plane 34 best seen in FIG. 3 before they project outwards with angled leg ends 35 which, between them, enclose the actual hook 36 whose hook end 37 is bent back and, in fact, projects into the interior of the yoke. The yoke 31, together with the hook section 32, bounds an enclosed eye 38 which, in this embodiment, has another function to be more fully described.

The yoke 31 of the connector 30 serves mainly as a handle to be threaded through the selected weft bundles 24',24" with its free yoke end or crosspiece 39 per FIGS. 13 and 14. After threading, these finally arrive in the hook section 32 having the special curled form which is best seen in FIG. 3 and creates two diametrically opposite bearing locations 41,42 in its hook opening profile 40. The one bearing location 41 is generated by corresponding recesses in the leg ends 35 while the other bearing location 42 in the intervening gap lies at the apex of the backwardly bent hook 36 as best seen in FIG. 4. Per FIG. 3, the indicated connecting line 43 between the two bearing locations 41,42 is approximately perpendicular to the mentioned plane 34 of the actual yoke 31. As a result, the one weft bundle 24' comes to rest at the bearing location 42 and the other 24" at the opposed bearing location 41 in the hook section 32 when the condition of use of the window drape shown in FIGS. 13 and 14 exists. Due to gravity, the connecting line 43 lies in a vertical plane parallel to the web sections 18',18" beginning at the two weft bundles 24' and 24". The intervening region 19 of the fabric web 11 is gathered to a horizontal pleat 44 whose pleat foot 45, as can also be seen from FIG. 1, is located at the individual connectors 30 while, by virtue of gravity, the pleat body, in free fall, always lays itself over the lower vertical web section 18' of the fabric web 11. This horizontal pleat thus remains when the fabric web 11 is in the extended condition which is shown in FIGS. 1 and 14 and is produced by the weight of the fabric web and the weighing rod 12 with the frill 14. The plane 34 of the yoke 31 which is perpendicular to this connecting line 43 accordingly assumes a horizontal position which is best seen in FIG. 14 and fixes itself. Thus, the mentioned yoke eye 38 is free to be used as a guide section for the passage of a drawstring 21 whose lower string end portion 27 is secured to the weighing rod 12 whereas its upper string end portion 28 is utilized to raise the fabric web 11. To this end, the embodiment of the drape in FIG. 1 has a carrier in the form of a rod 29 mounted in the upper region of the window which, in the case of FIG. 1, is provided with deflecting members 49 for the upper end 28 of the string 21 and simultaneously serves for secure attachment of the upper marginal portion 48 of the fabric web 11. In this embodiment, the horizontal pleats 44 extend continuously over the entire width of the window drape 10 which, however, is not necessary as demonstrated with reference to FIGS. 8A to 12B. The term "horizontal pleat" primarily indicates only the actual respective intermediate region 19 of the fabric web 11 collected by such a connector 30.

In FIGS. 8B to 12B, there are respectively seen the four folding bands 20 which are distributed on the rear side of the fabric web in the four rows 16,16',17,17' indicated there. Here, e.g., in FIG. 9B, those weft bundles 24 which, as a bundle pair 24',24" illustrated in FIG. 11, are respectively engaged by a connector 30 and drawn together to produce a permanent pleat 44 are indicated by arcs 46. This can take place in very different ways as shown by FIGS. 8B to 12B with a correspondingly entirely different appearance of the drape 10 on the visible side per FIGS. 8A to 12A. The respective Figures with the same numbers show the looping of the connector 30 and the associated appearance of the hanging drape in the rest condition. The connectors 30 can be individually placed to thereby respectively produce a different appearance of the drape according to taste.

Figure 8B:
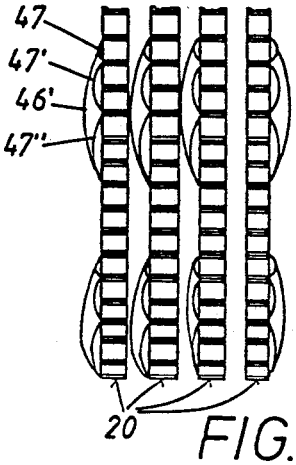

Thus, in the case of FIG. 8B, the connectors were initially threaded through at different vertical spacings from another per the arcs 47,47',47" with a further gathering of the weft bundles then still taking place according to the arc 46' via the two outermost weft bundles. Another than the previously described connector 30 could be used for this purpose. Consequently, a cascade-like pleat design, which extends transversely through the window drape 10, is obtained in accordance with FIG. 8A.

Figure 9A:
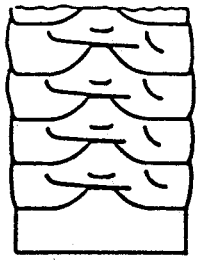
Figure 10A:
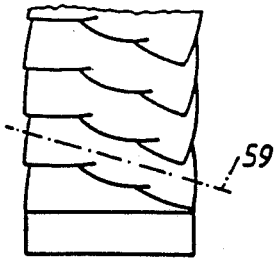
Figure 9B:
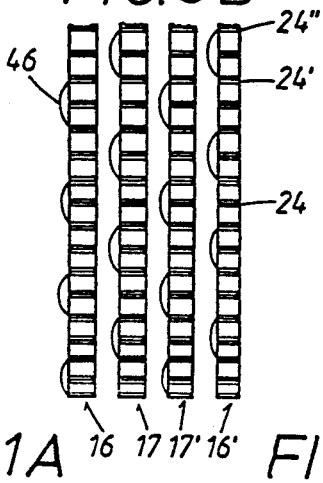
Figure 10B:
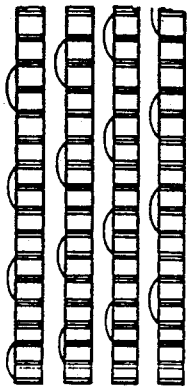

By means of an offset of the engaged bundles 24',24' of FIG. 9B in the individual rows 16 to 17', there is obtained the funnel-like pleat design of FIG. 9A. By threading through the individual connectors diagonally in accordance with FIG. 10B, the pleats shown in FIG. 10A and extending along the illustrated diagonal line 59 of FIG. 10 are obtained.

The threading of connectors in the individual folding bands 20 according to FIG. 11B produces the arc shape of FIG. 11A in the pleat design of the finished drape while the offset in the threading of the connectors as shown in FIG. 12B generates the loop shape, seen in FIG. 12A, in the pleat design of the fabric web.

The weft bundles 24 produced and used in accordance with the invention need not constitute part of a specially manufactured band 20 which is only later connected, in the manner described, to the fabric web 11 used in the production of the drape. Rather, it is possible to already work in the weft bundles 24 during the textile production of the fabric web 11 itself, i.e., such floating bundles of threads 24 are produced at localized regions along the subsequent vertical rows 16 to 17' during weaving or knitting of this web 11.

A particularly simple and effective measure is exhibited by the further embodiment of the invention illustrated in FIGS. 15 to 18. FIG. 18 shows, in a view similar to FIG. 14, the appearance of such a differently designed window drape 10'. In this case, also, a band 20' with the described weft bundles 24 is employed yet this, as seen from FIG. 15, is designed in a different manner than the first embodiment 10.

As observable from FIG. 15, the weft bundles 24 there function, at least in sections, for direct passage of a drawstring 21' which was worked in during the textile production of this band 20' and therefore need not be drawn through subsequently. The folding band 20' generated upon its textile production is thus equipped with a longitudinally extending drawstring 21' from the outset. Hence, when the band 20' is sewn to the band 11' of FIG. 15, the drawstring 21' already arrives at the window drape 10' which is then handled in the manner described in connection with the first embodiment. The mentioned connectors 30 are used here again and are threaded through the weft bundles 24',24" determined by the individual pleat formation in the previously outlined manner. It is, of course, possible to employ simpler connectors 30 and, to this end, alternatives are still described below. Consequently, there is formed in this region of the fabric web 11' also the horizontal pleat 44' seen in FIG. 18. The drawstring 21' passes through the weft bundles 24,24',24", which are visible in FIG. 18, of the web sections which, per FIG. 18, extend vertically in the hung condition but not the intermediate region 19' best seen in FIG. 15.

FIG. 16 illustrates a cross-sectional view through the drape along the section line XVI—XVI and it is observable that, in this region, the drawstring 21' passes through the gap 58, visible in FIG. 16, between the weft bundle 24 and the band base 22'. Thus, the weft bundles 24 which are here engaged from below undertake the additional function of directly being a guide element for the associated drawstring 21'.

On the other hand, in the case of FIG. 17, which illustrates a corresponding cross-sectional view through the fabric web 11' provided with the band 20', the drawstring 21' extends above the weft bundles 24 so that these are not effective for guidance thereof in this region. In the illustrated embodiment of FIG. 15, the drawstring 21 stretches freely above three consecutive weft bundles 57 before it again, as in FIG. 16, passes beneath the already mentioned, following weft bundle 24" to be engaged.

In the condition of use of the drape 10' per FIG. 18, this has the result that, after formation of the permanent horizontal pleat 44', the inner weft bundles 57 do not engage the drawstring 21' which, on the contrary, passes straight through into the adjoining, vertically extending web sections. The drawstring 21', which exits from below the weft bundle 24', goes directly further under the next weft bundle 24" located at the foot of the pleat. Consequently, the raising and lowering of the drape 10' is here also easy.

It is understood that the free passage of the drawstring 21' by the intermediate regions 19' which generate such pleats naturally depends upon the desired form of the pleats of the particular drape 10' which, as explained in connection with FIGS. 8A to 12A, may be selected to be very different. In order to provide different variations with a band 20', it would be possible, instead of a single drawstring 21', to have several parallel drawstrings, which pass above and below the various weft bundles 24,57 in different ways, extend longitudinally of such a folding band 20'. By selecting the appropriate drawstring 21', a specific pleat formation may then be selected from a number of different pleats 44' at different locations of such a vertical row of loops. A simpler alternative is to originally allow all of the weft bundles 24 to be engaged from below as in FIG. 16 so that the gaps 58 respectively located there fulfill the function of guide elements for the individual drawstring 21' because, by means of cuts in the respective intermediate region 19' which generates a pleat, the free stretches of the drawstring at these locations can be achieved subsequently. Fraying of the cut weft threads 25 on the base web 22' need not be of concern here if the cut ends are fixed by adhesion or fusion.

As is apparent, the special advantage of the embodiment of FIGS. 15 to 18 is that, on the one hand, it is unnecessary to provide additional guide elements for the drawstring 21' on the fabric web 11 and, on the other hand, manual threading of the drawstring 19' through the respective gaps 58 between the band web 22' and the weft bundles 24 is likewise unnecessary. This last has the result that the length of the drawstring 21' corresponds to the length of the band 20' in the smooth, extended condition. However, an excess length of the drawstring 21' is obtained by the formation of the fixed horizontal pleat 44' and can then be used at the string ends 28 for lifting as in FIG. 1. If the drawing device of FIGS. 14 and 15 is used in this case for the drawstring 21 there, then small excess lengths of the drawstring suffice for satisfactory raising of the window drape.

According to FIGS. 13 and 14, which would be similarly applicable to the embodiment of FIGS. 15 to 18, a horizontal carrier 50, on which a horizontal shaft 52 is rotatably journalled via bearing blocks 51, is arranged in the upper marginal web region 48. Take-up spools 53, to each of which a respective string end is secured, are seated on the shaft 52 in alignment with the various rows 16 visible in FIG. 13. A drive gear 55, which is favorably in a drive housing 54 per FIG. 13 and has a drive belt 56 or the like passing around the same, is fast with the horizontal shaft 52. By pulling on the belt 56, the shaft 52 is selectively rotated in the sense indicated by the double-headed arrow 69 shown in FIG. 14. This causes the drawstring 21 to be wound onto the spool 53 to a greater or lesser extent so that the drape 10 is moved from its extended position of FIG. 11 in which the front of the window is largely covered to a non-illustrated raised position. During this lifting of the fabric web 11, this bends further at the described, preformed feet 45 of the pleats since now the web section 18', which extended vertically until this time, tilts also. The leading, preformed horizontal pleats 44 thus determine the locations at which the fabric web 11 is gathered when the window drape 10 is raised. During lifting, also, the permanent horizontal pleats 44 cover the increasing compression below the same of the web section 18' and thereby assure a proper appearance of the window drape in each drawing position of its strings 21.

In the embodiment of FIGS. 5 to 7, an alternative connector 60 in accordance with the invention is illustrated in different views and conditions of use. This consists of a flexible element or strip 61 with thickened end sections 62,63 having an easily bendable bridge 64 between the same. At least one end section 63 is provided with a guide eye 68 which serves for the previously described passage of the subsequent drawstring 21. Furthermore, the two end sections 62,63 are provided with complementary locking portions or halves 65,66 serving to ensure that the deformed strip 61 retains its deformed shape and of which one, in the present embodiment, consists of a coupling plug 65 and the other of a receiving opening 66. During coupling, the two locking halves 65,66 can be joined to one another by elastic deformation and, as shown in FIG. 7, upon bending of the deformable bridge 64, finally form a ring-shaped body 67 beyond which the longer end section 63 with the guide eye 68 projects.

It is understood that other forms of ring-shaped bodies 67 may also be used. In those cases, as in the second embodiment of the drape 10' according to FIGS. 15 to 18, where a special guide element is unnecessary, a simplified connector 60 per FIGS. 5 to 7, which does not contain an end section 63 having a guide eye 68 and projecting beyond the annular body 67, may be used. The ring shape itself is then sufficient and may either be designed rigidly in the form of a bent back hook 36 as in the connector 30 or so as to be subsequently shaped to an annular body 67 according to FIG. 7 by deformation.

In the connector 30 of FIGS. 2 to 4, the hook 36 extends vertically during use, that is, in the longitudinal direction of the band, while the eye 38 defined by the yoke 31 lies horizontally as has been described. In the connector 60 of FIGS. 5 to 7, the annular body 67 lies in a vertical plane of the drape 10 after folding of the strip end sections 62,63 and perpendicular to the horizontally extending weft bundles 24',24'' engaged thereby.

We claim:

1. A window drape, comprising a web of flexible material having opposed first and second marginal portions, one of said marginal portions being mountable on a carrier to suspend said web with the other of said marginal portions below said one marginal portion; a line for drawing said other marginal portion towards said one marginal portion so as to raise said web when the latter is suspended, said line having an end portion which is secured to said web in the region of said other marginal portion; at least one row of projecting bundles extending in a direction from said first to said second marginal portion on one side of said web; said projecting bundles being spaced from one another when said web is flat, and each of said projecting bundles including a group of weft threads mounted on said web and projecting outwardly from said one side; and a holding element engaging two of said projecting bundles in such a manner that the portion of said web intermediate said two projecting bundles defines a pleat in all positions of said web when said web is suspended, said holding element comprising a guide section for said line, said line extending through the guide section of each said holding element.

2. The drape of claim 1, further comprising a substantially horizontal carrier element for said web; and wherein said one marginal portion is secured to said carrier element.

3. The drape of claim 1, further comprising at least one additional row of projecting bundles substantially paralleling said one row, said projecting bundles of said additional row being spaced from one another and resembling said projecting bundles of said one row.

4. The drape of claim 1, further comprising a carrier band secured to said web and carrying said one row of projecting bundles.

5. The drape of claim 1, wherein said projecting bundles are arranged to extend substantially normal to said web.

6. The drape of claim 1, wherein said guide section is of one piece with said holding element.

7. The drape of claim 1, wherein said line passes through selected ones of said projecting bundles.

8. The drape of claim 1, wherein at least one of said projecting bundles is disposed in said pleat between said two bundles and said line bypasses said pleat and said one projecting bundles.

9. The drape of claim 1, further comprising a rotatable spool; and wherein said line has another end portion which is secured to said spool so that said line can be wound onto said spool upon raising of said web.

10. The drape of claim 9, further comprising a carrier element for said web mounted at a predetermined location; and wherein said one marginal portion is mounted on said carrier element and said spool is disposed in the region of said carrier element.

11. The drape of claim 1, wherein said holding element has a holding section which engages said two projecting bundles, said holding section being substantially ring-shaped.

12. The drape of claim 11, wherein said holding section comprises a flexible element which is deformed substantially into the shape of a ring, and means for maintaining said shape.

13. The drape of claim 12, wherein said flexible element is strip-shaped and said maintaining means comprises a pair of complementary locking portions on said flexible element.

14. The drape of claim 1, wherein said holding element comprises a hook-like section.

15. The drape of claim 14, wherein said holding element further comprises a handle fast with said hook-like section.

16. The drape of claim 15, wherein said handle comprises a yoke defining an enclosed opening.

17. The drape of claim 16, wherein said yoke is of one piece with said hook-like section.

18. The drape of claim 16, wherein said yoke has a pair of legs flanking said hook-like section and the latter has an end portion projecting into said opening.

19. The drape of claim 18, wherein said holding element further comprises a crosspiece extending between said legs.

20. The drape of claim 15, wherein said hook-like section defines an aperture designed to receive part of each of said two projecting bundles, said hook-like section being provided with a bearing area for each of said parts, and said bearing areas being disposed at diametrically opposite locations of said aperture.

21. The drape of claim 20, wherein said handle defines a plane which is substantially perpendicular to a connecting line between said bearing areas.

* * * * *